United States Patent [19]

Ziegler

[11] Patent Number: 4,502,743

[45] Date of Patent: Mar. 5, 1985

[54] GROUND BRACKET ASSEMBLY INCLUDING OMEGA SHAPED COMPRESSION MEMBER

[76] Inventor: Hans J. Ziegler, 4828 N. Newhall St., Milwaukee, Wis. 53217

[21] Appl. No.: 494,902

[22] Filed: May 16, 1983

[51] Int. Cl.[3] ..... H01R 4/66

[52] U.S. Cl. ..... 339/14 L; 339/246

[58] Field of Search ..... 339/14 R, 14 L, 296, 339/249 A, 263 R

[56] References Cited

U.S. PATENT DOCUMENTS

| | | | |
|---|---|---|---|
| 1,979,091 | 10/1934 | Alsaker et al. | 339/246 |
| 3,924,920 | 12/1975 | Moscioni et al. | 339/246 |
| 4,131,257 | 12/1978 | Sterling | 339/246 X |
| 4,136,423 | 1/1979 | Sterling | 339/246 X |

OTHER PUBLICATIONS

"C-Service Wire Clamp", Gilbert et al., Western Electric Tech. Digest, No. 49, Jan. 1978, pp. 11-12.

*Primary Examiner*—Eugene F. Desmond

[57] ABSTRACT

An electrical cable clamp for retaining a plurality of multi-conductor cables having electrically conductive sheaths in fixed disposition and for grounding the shields of those cables. The cable clamp includes a ground bracket comprised of a flat metal strip stamped to form a plurality of U-shaped open ended channels integrally joined together by a web. Each channel includes a rearward wall, and a pair of side walls extend forwardly from the rearward wall. A compression member is provided for compressing a plurality of cables together in electrically conductive relation and for forcing the cables against the rearward wall portions of the channels in electrical contact. The compression member includes a pair of spaced apart parallel legs slideably housed in the respective channels. The legs each include a free end having a jaw member extending between the side walls of the channels and adapted to engage cables and to force them against the rearward walls of the channels.

9 Claims, 2 Drawing Figures

GROUND BRACKET ASSEMBLY INCLUDING OMEGA SHAPED COMPRESSION MEMBER

FIELD OF THE INVENTION

The invention relates to electrical cable clamps, and more particularly, to clamps adapted to mechanically retain a plurality of telephone service wires together such that the electrically conductive shields of those service wires are clamped together in electrical contact to cause those shields to have a common electrical potential and to facilitate connection of such shields to a common electrical ground.

RELATED APPLICATIONS

This application is related to Applicant's copending U.S. patent application Ser. No. 338,129, filed Jan. 8, 1982 and titled "Ground Bracket Assembly".

DESCRIPTION OF THE PRIOR ART

In the installation of telephone communication and transmission lines, it is frequently desirable to clamp a selected number of service wires from a cable bundle in fixed position with respect to each other preliminary to directing certain of the clamped service wires to a certain location or zone. Such service wires commonly include a plurality of individual conductor wires which are incased by a tubular wrapped or braided shield of copper, brass or aluminum. The shield acts as an electrical shield for transmissions through the wire conductors and provides a common ground path. These shields are surrounded by an insulating jacket. The conductor shields are to be joined so as to be at a common electrical potential and are also intended to be connected to an electrical ground. A prior art cable clamp arrangement for joining a number of service wires together and for connecting the electrical shields of those service wires to an electrical ground is illustrated in the Sterling U.S. Pat. No. 4,136,423, issued Jan. 30, 1979.

One of the features of the prior art cable clamp arrangements, such as that shown in the Sterling patent, is that it is necessary to insert the service wires from a rearward portion of the clamp assembly and then tighten a bolt or screw which is on a forward or front side of the bracket or clamp assembly. Accordingly, the operator must have access to both the rearward and the front sides of the cable clamp assembly. Additionally, since the service wires must be inserted into the clamp assembly from the rearward side of the bracket or clamp assembly where access may be limited, placement or arrangement of the wires in the bracket assembly can be difficult and time consuming. Another problem associated with prior art clamp assemblies is that they commonly comprise several components which must be secured together in electrically conductive relation to provide a suitable electrical ground. If these parts are allowed to corrode or if they are improperly assembled, the electrical connection between these parts may be insufficient to achieve electrical ground.

SUMMARY OF THE INVENTION

The present invention provides an improved ground bracket assembly for restraining a plurality of service wires together and for insuring electrical connection of the shields of the service wires and connection of the shields to a common ground and in such a manner that the electrically conductive shields of the service wires are maintained at a common electrical potential.

The ground bracket assembly embodying the invention includes a one piece bracket body which can be joined directly to an electrical ground, and one or more compression tabs or clamp members adapted to compress a number of cables together. The bracket body and the clamp members are particularly constructed such that the bundles of service wires can be firmly engaged to insure electrical contact of the shields of the service wires and to affect grounding of the shields. The ground bracket assembly is also particularly constructed such that the service wires can be easily inserted from the forward or front side of the assembly thereby making it easier to place the service wires in the clamp assembly. One of the principal features of the invention is that the one piece bracket body and the associated clamp member are readily manufactured at minimum cost.

More particularly, the invention includes an electrical cable clamp for retaining multi-conductor cables having electrically conductive sheaths in fixed disposition and providing means for grounding the sheaths or shields of those cables or service wires. The cable clamp comprises a ground bracket body adapted to be connected to an electrical ground, the body being comprised of an electrically conductive metal strip which is shaped so as to form a pair of spaced apart forwardly opening channels. The channels are joined by an integral web. The channels are each intended to house one or more of the multi-conductor cables. Means are also provided for compressing cables together in the channels in electrically conductive relation and for forcing at least a portion of one of the cables against the ground bracket body in electrical contact. The means for compressing includes a U-shaped or Omega shaped compression member having a pair of spaced parallel legs, one of the legs being adapted to be slidably housed in one of the channels and the other of the legs being adapted to be housed in the other of the channels. A first jaw member extends from a free end of one leg between the side walls of the channel and is adapted to engage cables and to force them together and against the ground bracket body. A second jaw member extends from a free end of the second leg and between the side walls of the other channel and is adapted to engage cables and to force them together and against the ground bracket body. Means are also provided for forcing the jaw members toward the rearward wall portion to compress the cables against the rearward wall of the ground bracket body.

In one preferred embodiment of the invention the means for forcing the jaw members toward the rearward wall includes a screw extending through the compression member and being threadably housed in a central bore in the ground bracket body. In a preferred form of the invention a belleville washer is also provided between the head of the screw and the ground bracket body, to maintain the compressive forces which might otherwise lessen due to plastic deformation of the conductors.

Various other features and advantages of the invention will be apparent from the following description of a preferred embodiment, from the drawings and from the claims.

Figure 1:
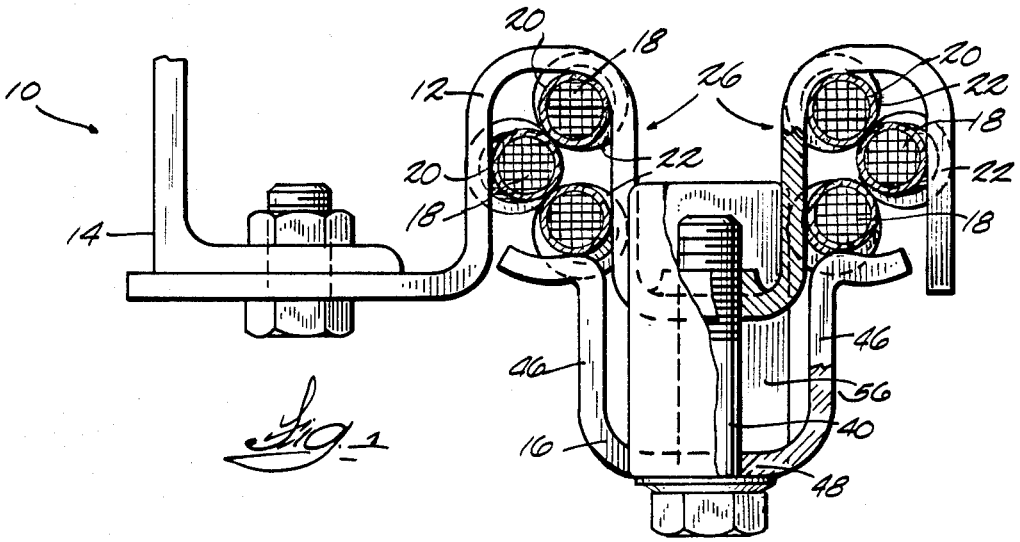
FIG. 1 is a plan view of apparatus illustrated in FIG. 1 and with portions broken away.
Figure 2:
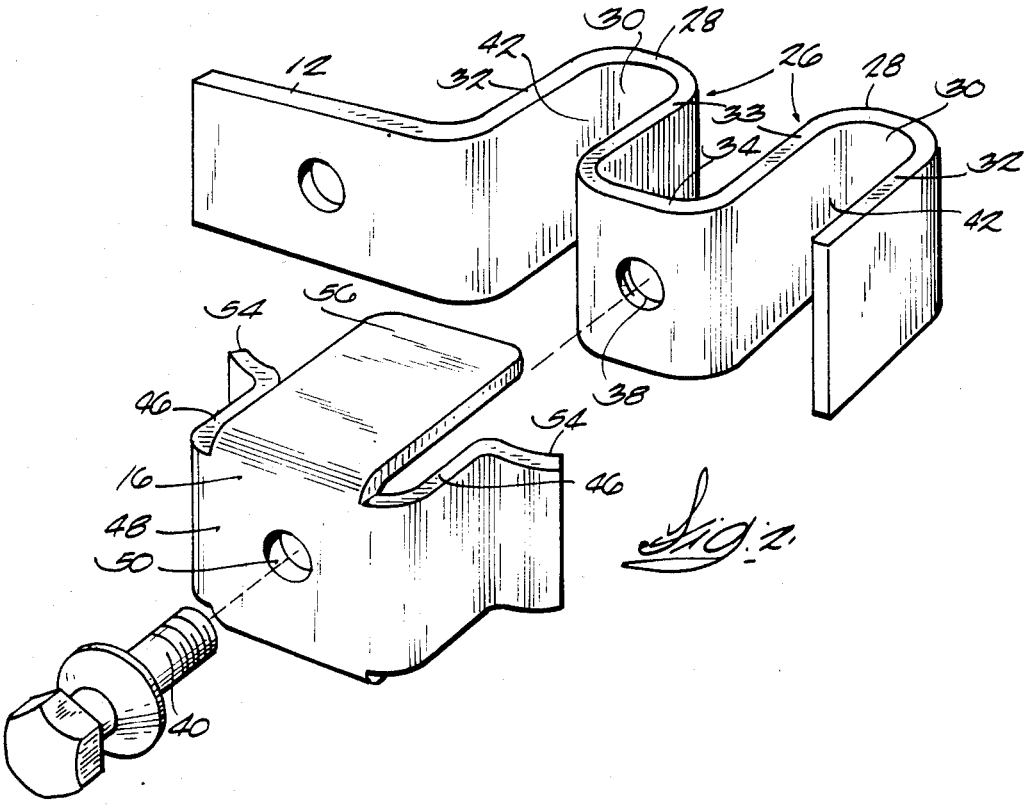
FIG. 2 is an exploded perspective view of the ground bracket assembly illustrated in FIG. 1.

Before describing preferred embodiments of the invention in detail, it is to be understood that the invention is not limited to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a ground bracket assembly 10 embodying the present invention and generally including a bracket body 12 adapted to be connected to a suitable electrical ground (not shown) and supported by a supporting means such as supporting structure 14. The ground bracket assembly 10 also includes at least one compression member 16 supported by the bracket body 12 and adapted to clamp bundles of service wires 18 against the ground bracket body 12. The service wires 18 are conventional buried or aerial service wires each including a plurality of insulated wires bundled together and surrounded by an extruded or braided shield or sheath 20 comprised of electrically conductive material, the shield 20 being adapted to be grounded and being intended to protect the wires therein from electrical interference. The electrically conductive shield 20 is surrounded by an insulative jacket 22. A portion of this insulative jacket 22 of each of the cables 18 is to be removed to expose the conductive shield 20, and the cables are to be clamped together such that the shields 20 are all at a common electrical potential and joined to an electrical ground. The compression members 16 and the bracket body 12 provide a means for clamping a selected number of cables 18 together in fixed disposition and to cause the shields 20 of those cables 18 to be clamped together in electrical contact so as to be at a common potential and to provide for electrical connection between the cable shields and an electrical ground.

Referring more particularly to the bracket body 12 illustrated in FIG. 1, in a preferred form of the invention, the bracket body 12 is fabricated of a highly conductive metal such as tin plated brass in sheet or strip form, this sheet metal being stamped or otherwise bent to form a configuration as illustrated in FIG. 1. More particularly, while the bracket body 12 may have other configurations and which configurations are dependent on the intended use of the bracket and its selected environment, in the illustrated arrangement the bracket body 12 defines a pair of forwardly opening stamped channels 26. Each forwardly opening channel 26 is comprised of a rearward wall or base portion 28 having a forward surface 30 and a pair of side walls 32 and 33 integral with the rearward wall 28 and projecting forwardly from the rearward wall 28 at right angles. The forwardly projecting ends of the side walls 32 of adjacent channels 26 are integrally joined by a transverse connecting boss or web 34.

The transverse web 34 includes a central tapped bore 38 adapted to threadably house a screw or bolt 40.

The compression member 16 is also formed from a stamped metal strip of the same highly conductive metal sheet material as is employed in forming the bracket body 12. The compression member 16 is generally U-shaped or omega shaped when viewed as in FIG. 1 and includes a pair of generally planar parallel spaced apart legs 46, the legs 46 being adapted to be slidably received in the cavities 42 of the channels 26 such that the compression member 16 is movable forwardly and rearwardly with respect to the bracket body 12. The legs 46 are integrally joined at their forward ends by a connecting portion or central boss 48. The central boss 48 includes a bore 50 adapted to house the screw 40, the bore 50 being larger in diameter than the screw 40 such that the screw is freely rotatable in the bore 50. When the legs 46 of the compression member 16 are housed in the cavities 42, the legs 46 are adapted to be positioned closely adjacent the sidewalls 33 but spaced from the side walls 33 such that the compression member 16 is freely slideably moveable.

The free ends or rearwardly extending ends of the legs 46 of the compression members 16 also each include a jaw member 54 which extends transversely from the leg 46 and outwardly therefrom toward the side walls 32 of the bracket body 12. The jaws 54 each have a free end adapted to be positioned closely adjacent a respective side wall 32 but spaced from the side wall such that the compression member 16 is freely movable toward and away from the bracket body 12.

In the illustrated construction the compression members 16 also include means for stabilizing the compression member 16 as it engages the ground bracket body 12. This means is shown as including a pair of upper and lower tabs or ears 56 integrally joined to the upper and lower edges of the boss 48 and extending rearwardly therefrom such that they will slide over the upper and lower edges of the web 34 and the sidewalls 33 of the channels 26.

In operation of the ground bracket assembly 10, the outer insulative jacket 22 is removed from a plurality of the cables 18 to expose a length of the electrically conductive shields 20 of the cables. The compression members 16 are retracted to a position such that the cables 18 can be inserted into channels 26 between the jaws 54 and the side walls 32 and 33 of the bracket body 12. Several such cables are bunched and placed between the side walls 32 and 33 of the channels 26 and the adjacent legs 46 of the compression members 16 and between the jaws 54 and the rearward wall 28. The screw 40 is then tightened to cause the compression member 16 to move toward the rearward wall 28 of the bracket body 12 and to cause the jaws 54 to engage the cables 18 and to clamp the cables 18 against the rearward walls 28, thereby clamping the electrically conductive sheaths 20 of the cables together and to clamp those sheaths against the bracket body 12 to effectively ground the cables.

In a preferred form of the embodiment of the invention illustrated in FIG. 1, the threads at the end of the screw 40 projecting through the threaded bore 38 can be upset to prevent removal of the screw 40 from the bracket body 12 and to restrict the range of movement of the associated compression member 16. In this arrangement, once the screw 40 is threaded through the tapped bore 38 in the bracket body 12 and the threads at the end of the screw 40 are upset, the compression member 16 will have limited movement with respect to the bracket body 12. It is intended that the compression member be movable forwardly only sufficiently that cables 18 may be freely inserted between the ends of the jaws 54 and the forward ends of the side walls 32.

One of the features of the invention is that the cables 18 can be inserted into the ground bracket assembly 10 from the front or a forward portion of the bracket assembly, and the screw or bolt 40 for tightening the compression members 16 against the bracket body 12 is similarly accessible from the forward portion of the bracket assembly. Accordingly, the ground bracket assembly 10 embodying the invention does not require the operator to reach behind the bracket assembly to insert the cables. Another advantage of the ground bracket assembly of the invention is that the bracket assembly can be secured to a flat surface since access to a rearward portion of the bracket assembly is not required. Other principal advantages of the ground bracket assembly described above are that it can be easily manufactured; it includes a minimum number of components parts; and can be constructed of strip stock and other components which are readily available.

While the clamp assembly defined above has been identified as being particularly well suited to provide a means for grounding the conductive shields of telephone cables and the like, it should be understood that there are other useful applications for the construction set forth above.

Various features of the invention are set forth in the following claims.

I claim:

1. An electrical cable clamp for retaining multi-conductor cables having electrically conductive shields in fixed disposition and providing means for grounding the shields of those cables, the cable clamp comprising a ground bracket body adapted to be connected to an electrical ground, said body being comprised of an electrically conductive metal strip, said metal strip being shaped so as to form a pair of forwardly opening spaced apart U-shaped channels adapted to house therein a plurality of multi-conductor cables, each of said channels including a rearward wall portion having opposite ends and a surface for supporting cables, and a pair of side walls integral with said rearward wall portion and extending forwardly from said rearward wall portion and extending generally perpendicularly to said rearward wall portion, the forward end of one of said side walls of one of said channels being joined by a web to a forward end of an adjacent side wall of an adjacent channel, said web including a bore, means for compressing a plurality of cables together in electrically conductive relation and for forcing at least a portion of one of said cables against said ground bracket body in electrical contact, said means for compressing including a compression member including a pair of spaced parallel legs, one of said legs being adapted to be insertable into one of said channels, said one of said legs including an end adapted to engage cables housed in said one of said channels and to force them together and against said ground bracket body and a second leg adapted to be inserted into the other of said channels, said second leg having an end adapted to engage said cables in said second channel and to force them together and against said ground bracket body, and means for forcing said ends of said legs into said channels to compress the cables therein.

2. An electrical cable clamp as set forth in claim 1 wherein said compression member is comprised of a U-shaped metal strip, said legs each being generally planar and said legs being joined by a transverse portion, said transverse portion having a central bore.

3. An electrical cable clamp as set forth in claim 2 wherein said means for forcing said ends of said legs toward said rearward wall portion includes a screw extending through said transverse portion and threadably housed in said bore in said web, said screw including a head adapted to engage said transverse portion whereby said head forces said transverse portion of said compression member toward said web when said screw is threaded through said bore in said web.

4. An electrical cable clamp as set forth in claim 1 wherein said compression member is comprised of a U-shaped metal strip, and wherein said legs are each generally planar, one of said legs being slidably supported adjacent one of said side walls of one of said channels and said one of said legs including a free end defining a compression jaw transverse to said one of said legs and extending between said spaced side walls of said one channel.

5. An electrical cable clamp for retaining a plurality of multi-conductor cables having electrically conductive sheaths in fixed disposition and providing means for grounding the sheaths of those cables, said cable clamp comprising a ground bracket body adapted to be connected to an electrical ground, said ground bracket body being comprised of a metal strip bent to form a plurality of U-shaped open ended spaced apart channels integrally joined together, each of said channels being adapted to house at least one cable and including a generally planar rearward wall portion having opposite ends and a forward surface for supporting the cable, a pair of side walls extending forwardly from said opposite ends of said rearward wall portion, means for integrally joining a forwardly extending end of one of said side walls of a first channel to a forwardly extending end of an adjacent side wall of an adjacent channel, means for compressing said at least one of said cables against the ground bracket body in electrically conductive relation and for forcing at least a portion of said at least one of said cables against said rearward wall portion of one of said channels in electrical contact, said means for compressing including a compression body including a pair of spaced parallel legs, one of said legs being slidably housed in one of said channels and a second leg housed in an adjacent one of said channels, said one of said legs including a free end defining a first jaw member extending between said side walls of said one of said channels, and said other of said legs including a free end defining a second jaw member extending between said side walls of said adjacent one of said channels, said jaw members being adapted to engage cables and to force them against said rearward wall portions of said channels, and means for forcing said jaw members toward said rearward wall portion to compress said cables between said jaw members and said rearward wall portions of said channels.

6. An electrical cable clamp as set forth in claim 5 wherein said ground bracket body includes a threaded bore and wherein said means for forcing said jaw members toward said rearward wall portions of said channels includes a screw extending through said compression member and threadably housed in said threaded bore.

7. An electrical cable clamp for retaining multi-conductor cables having electrically conductive shields in fixed disposition and providing means for grounding the shields of those cables, the cable clamp comprising a ground bracket body adapted to be connected to an electrical ground, said body being comprised of an electrically conductive one piece metal strip, said metal strip being bent so as to form a pair of forwardly opening spaced apart U-shaped channels adapted to house therein a plurality of multi-conductor cables, each of said channels including a rearward wall portion having opposite ends and a surface for supporting cables, and a pair of side walls integral with said rearward wall portion and extending forwardly from said rearward wall portion and extending generally perpendicularly to said rearward wall portion, the forward end of one of said side walls of one of said channels being joined by a web to a forward end of an adjacent side wall of an adjacent channel, said web including a bore, means for compressing a plurality of cables together in electrically conductive relation and for forcing at least a portion of one of said cables against said ground bracket body in electrical contact, said means for compressing including a compression member including a pair of spaced parallel legs, one of said legs being adapted to be insertable into one of said channels and so as to be positioned adjacent one of said side walls of said one of said channels and slidably moveable toward and away from said rearward wall of said one of said channels, said one of said legs including an end portion extending toward the other of said side walls of said one of said channels, said end portion being adapted to engage cables housed in said one of said channels and to force them together and against said ground bracket body, and a second leg adapted to be inserted into the other of said channels so as to be positioned adjacent one of said side walls of said other of said channels and slidably movable toward and away from said rearward wall of said other of said channels, said second leg having an end portion extending toward the other of the side walls of said other of said channels, and said end portion of said second leg being adapted to engage said cables in said second channel and to force them together and against said ground bracket body, and means for forcing said end portions into said channels to compress the cables therein.

8. An electrical cable clamp as set forth in claim 7 wherein said compression member is comprised of a U-shaped metal strip, said legs each being generally planar and said legs being joined by a transverse portion, said transverse portion having a central bore.

9. An electrical cable clamp as set forth in claim 8 wherein said means for forcing said end portions into said channels includes a screw extending through said transverse portion and threadably housed in said bore in said web, said screw including a head adapted to engage said transverse portion whereby said head forces said transverse portion of said compression member toward said web when said screw is threaded through said bore in said web.

* * * * *